US009719676B2

(12) United States Patent
Schmid et al.

(10) Patent No.: US 9,719,676 B2
(45) Date of Patent: Aug. 1, 2017

(54) DRAINING A POWER PLANT

(71) Applicant: SIEMENS AKTIENGESELLSCHAFT, München (DE)

(72) Inventors: Erich Schmid, Nürnberg (DE); Michael Schöttler, Erlangen (DE); Anja Wallmann, Erlangen (DE)

(73) Assignee: SIEMENS AKTIENGESELLSCHAFT (DE)

( * ) Notice: Subject to any disclaimer, the term of this patent is extended or adjusted under 35 U.S.C. 154(b) by 7 days.

(21) Appl. No.: 14/652,194

(22) PCT Filed: Dec. 3, 2013

(86) PCT No.: PCT/EP2013/075334
§ 371 (c)(1),
(2) Date: Jun. 15, 2015

(87) PCT Pub. No.: WO2014/095337
PCT Pub. Date: Jun. 26, 2014

(65) Prior Publication Data

US 2015/0323176 A1 Nov. 12, 2015

(30) Foreign Application Priority Data

Dec. 19, 2012 (EP) ..... 12198121

(51) Int. Cl.
*F22B 37/50* (2006.01)
*F22B 37/48* (2006.01)
(Continued)

(52) U.S. Cl.
CPC ..... *F22B 37/486* (2013.01); *F01K 23/10* (2013.01); *F22B 37/50* (2013.01); *F28G 9/00* (2013.01)

(58) Field of Classification Search
CPC ..... F22B 37/486; F22B 37/50; F28G 9/00; F01K 23/10
(Continued)

(56) References Cited

U.S. PATENT DOCUMENTS 3,008,295 A 11/1961 Profos
4,430,962 A 2/1984 Miszak
(Continued)

FOREIGN PATENT DOCUMENTS

WO WO 9707323 A1 2/1997
WO WO 2006058845 A1 6/2006
WO WO 2012066490 A1 5/2012

OTHER PUBLICATIONS

International Search Report; PCT/EP2013/075334; International Filing Date: Dec. 3, 2013; 3 pgs.

*Primary Examiner* — Steven A. Reynolds
(74) *Attorney, Agent, or Firm* — Schmeiser Olsen & Watts LLP

(57) ABSTRACT

A power plant, particularly a coupled gas and steam power plant, including a plurality of first drainage lines that are fluidically connected on the upstream side to a water-steam circuit and are fluidically connected on the downstream side to an overpressure vessel, is provided. Additionally, at least one steam-conducting supply line, via which steam can be fed back to the water-steam circuit, is fluidically connected to the overpressure vessel. A method for operating such a power plant, wherein the at least one steam-conducting supply line can supply steam to the water-steam circuit in the region of a low-pressure stage, particularly in the region of the steam drum of the low-pressure stage is also provided.

13 Claims, 2 Drawing Sheets

Figure 1:
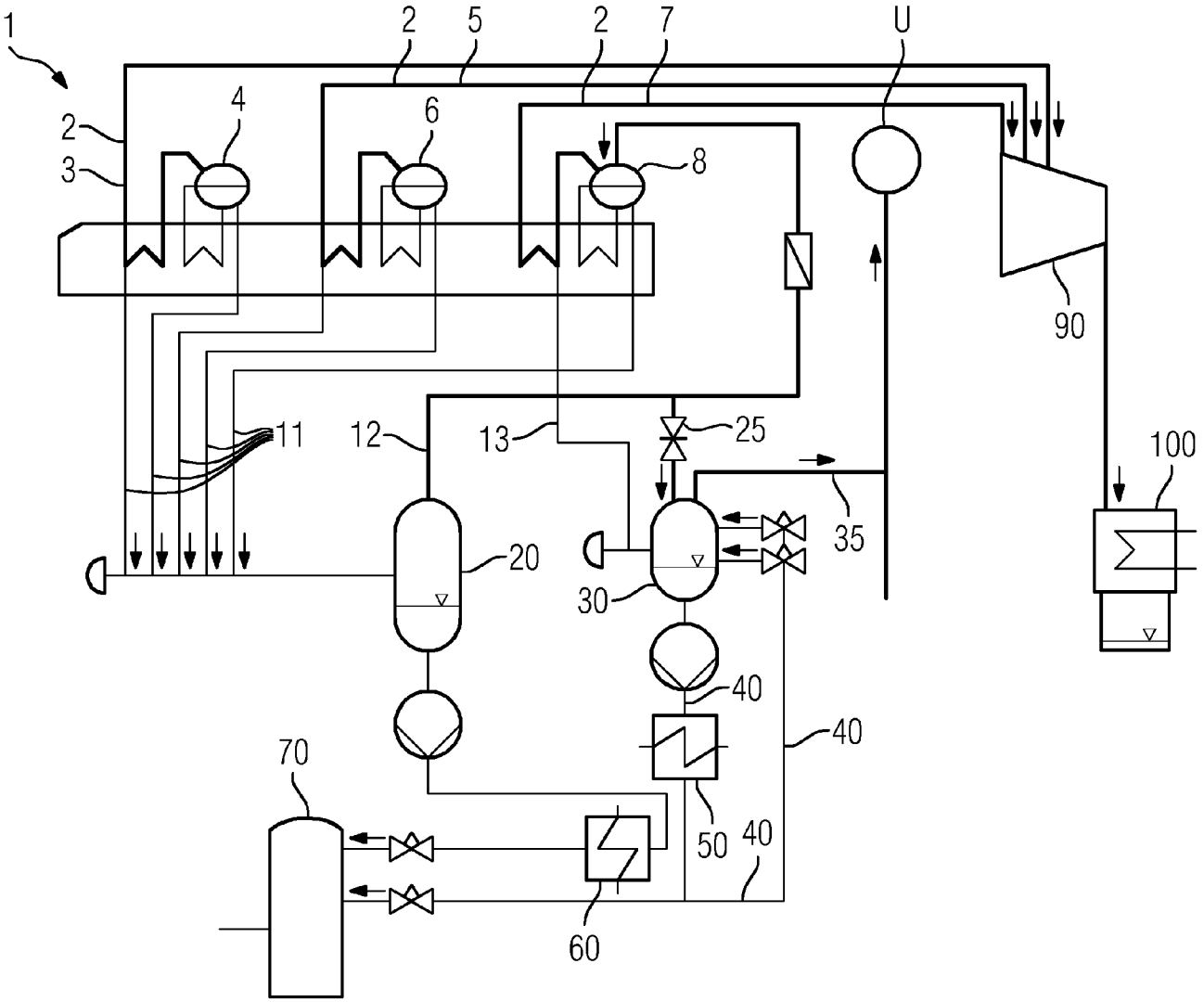

(51) Int. Cl.
*F01K 23/10* (2006.01)
*F28G 9/00* (2006.01)

(58) Field of Classification Search
USPC ..... 60/783, 39, 182, 39.182; 122/384
See application file for complete search history.

(56) References Cited

U.S. PATENT DOCUMENTS

| | | | | |
|---|---|---|---|---|
| 2003/0037534 | A1* | 2/2003 | Sugishita | F01K 23/106 60/39.182 |
| 2007/0289304 | A1 | 12/2007 | Wallmann | |
| 2008/0104959 | A1 | 5/2008 | Wallmann | |
| 2014/0000259 | A1* | 1/2014 | Hermsdorf | F01K 3/24 60/646 |
| 2015/0203392 | A1* | 7/2015 | Seiki | F01K 23/068 60/39.12 |

* cited by examiner

DRAINING A POWER PLANT

CROSS-REFERENCE TO RELATED APPLICATIONS

This application claims priority to PCT Application No. PCT/EP2013/075334, having a filing date of Dec. 3, 2013, based on EP 12198121.1 having a filing date of Dec. 19, 2012, the entire contents of which are hereby incorporated by reference.

FIELD OF TECHNOLOGY

The following relates to a power plant, especially a coupled gas and steam power plant, which has a number of drainage lines for draining a water-steam cycle, and also relates to a method for operating such a power plant.

BACKGROUND

Steam-operated power plants, especially coupled gas and steam power plants, have a water-steam cycle which sometimes can also be designed as one or more assisted circulation steam generators with steam drums and also associated heating surfaces. Such assisted circulation steam generators are commonly divided into a high-pressure stage, an intermediate pressure stage and a low-pressure stage depending on its working pressure regime. Generated inside individual pressure stages of the water-steam cycle, by absorbing thermal energy, is water steam (simply referred to as steam in the following text) which can be fed to one or more steam turbines for electric power generation. Instead of being designed as an assisted circulation steam generator of the power plant, the steam generator can also be designed as a forced flow steam generator (Benson boiler, Sulzer boiler, etc.). Such assisted circulation steam generators, however, are for the most part provided only in the high-pressure stage of the water-steam cycle, but can basically also be provided for the lower pressure stages.

On account of numerous chemical and physical processes, waste water, which is provided to a greater or lesser extent with impurities, accumulates in the water-steam cycle during operation of the power plant. So as not to impair the readiness of the power plant by these impurities during operation, it is necessary to drain the power plant and therefore to remove the impurities or the waste water from the water-steam cycle. Such draining is typically undertaken during continuous operation of the power plant. During this, the drainage waters are discharged from lines, which are normally closed during normal operation, in which the waste water has collected. For the discharging process, the subject lines are opened for a short time and the drainage waters are drained away. During the draining, water is therefore lost to the water-steam cycle and, renewed by make-up water, so-called deionized water, has to be fed to the water-steam cycle.

In addition, condensation water, which opposes an efficient utilization of the water-steam cycle, also collects in the lines of said water-steam cycle. Such condensation water is formed especially on account of time-related changing operating conditions in the water-steam cycle. Condensation water thus accumulates in the water-steam cycle when power plants are shutting down, for example, since with reducing operating temperatures the steam which is present in the water-steam cycle increasingly condenses out and the thereby accumulating condensed water also collects in parts of the plant which are not intended for a longer contact with liquid water. In this respect, it is necessary when a power plant is shutting down to increasingly remove water from the water-steam cycle in order to avoid undesirable condensation of water in parts of the plant which are not intended for it. At the same time, less water is replenished into the water-steam cycle when shutting down in order to keep relevant parts of the plant largely free of condensed water at the end of the shutting down process.

In order to remove such condensation water from the water-steam cycle, suitable drainage lines, which are fluidically connected to the water-steam cycle, are also put into service. Sometimes, these are identical to the drainage lines for draining impure waste waters from the water-steam cycle.

At this point, reference is to be made to the fact that in the sense of the present invention, drainage waters of the power plant can be both impure waste water, such as sludge, and condensed water which has collected in regions of the water-steam cycle which are not intended for it.

According to the prior art, it is already known to collect and to conduct together drainage waters from different parts of the water-steam cycle, especially from different pressure stages. In this case, the drainage waters, as described for example in WO 2006/058845 (US 2008 0104959 A1), or in US 2007 0289304 A1, can be temporarily stored in a tank for further treatment.

It is disadvantageous to these solutions of the prior art, however, that by temporarily storing the drainage waters, the thermal energy contained therein cannot be further utilized. Rather, when ejecting the drainage waters the thermal energy is discharged from the power plant into the environment without being utilized. Moreover, it proves to be disadvantageous that the make-up water which is introduced into the water-steam cycle for replacing the discharged drainage waters have to be thermally treated again in order to be raised to a temperature level which corresponds or comes sufficiently close to the water already present in the water-steam cycle. This in turn requires expenditure of thermal energy and disadvantageously disrupts the energy balance of the power plant. Moreover, it proves to be disadvantageous that the drainage waters which are discharged from the water-steam cycle have to be treated in an energetically costly process in order to separate especially the sludge from water which is reusable as deionized water. It proves to be especially unfavorable with regard to resource balance if the treated water is no longer fed back into the water-steam cycle but for example is ejected into the environment.

According to these disadvantages which are known from the prior art it proves to be technically necessary to propose a solution for draining a power plant which avoids the disadvantages which are known from the prior art. The technical solution which is to be proposed is especially to enable an energetically advantageous utilization of the energy which is extracted as a result of discharging drainage waters from the water-steam cycle. In other words, draining which is improved with regard to the overall energy balance of the power plant operation is to be undertaken. Furthermore, it is desirable to re-utilize the energy discharged from the water-steam cycle and also the drainage waters for the power plant and especially for the water-steam cycle.

SUMMARY

An aspect relates to a power plant, especially a coupled gas and steam power plant, comprising a number of first drainage lines which are fluidically connected on the upstream side to a water-steam cycle having a plurality of pressure stages, and which on the downstream side are fluidically connected to an overpressure vessel, wherein at least one steam-conducting feed line is also fluidically connected to the overpressure vessel via which steam can be fed again to the water-steam cycle, wherein the at least one steam-conducting feed line can feed steam to the water-steam cycle in the region of a low-pressure stage, especially in the region of the steam drum of the low-pressure stage.

Aspects upon which embodiments of the invention are based are furthermore achieved by means of a method for operating a power plant as described previously and subsequently, comprising the following steps:

draining water and/or steam from a water-steam cycle by feeding to an overpressure vessel; and feeding back steam from the overpressure vessel to the water-steam cycle in the region of a low-pressure stage, especially in the region of the steam drum of the low-pressure stage.

The inventive idea teaches the draining of the water-steam cycle by means of a number of first drainage lines which are fluidically connected on the upstream side to the water-steam cycle. During the draining of the drainage waters via these first drainage lines, the drainage waters are introduced into an overpressure vessel in which expansion to a comparatively lower pressure level in comparison to the pressure level of the water-steam cycle can be established. The overpressure vessel, however, also has a pressure level which lies above the ambient pressure level. In this respect, an overpressure level exists inside it. During the expansion, on the one hand a reduction of the temperature level of the introduced drainage waters and preferably an at least partial evaporation of the liquid drainage waters take place. The steam which is present in the overpressure vessel, which furthermore has usable thermal energy, is fed again via the feed line, which is fluidically connected to the overpressure vessel, to the water-steam cycle for further utilization. This is particularly unproblematic since this steam does not contain any impurities and therefore can be fed again to the water-steam cycle in "purified" form. During the expansion in the overpressure vessel, the impurities remain mostly or even basically completely in the liquid phase, that is to say in the form of liquid water.

According to embodiments of the invention, it is furthermore provided that the at least one steam-conducting feed line can feed steam to the water-steam cycle in the region of a low-pressure stage, especially in the region of the steam drum of the low-pressure stage. The term "in the region" is to be understood in the sense of "in the local region", as is also explained further below. According to the embodiment, the connecting is carried out especially to the low-pressure stage, especially to the steam drum of the low-pressure stage. On account of the relatively lower pressure level which prevails in the low-pressure stage, a transfer of the steam from the overpressure vessel into the water-steam cycle is energetically especially favorable. It is especially conceivable that the pressure level of the steam in the overpressure vessel does not significantly lie below the pressure level of the low-pressure stage or lies at even the same pressure level or above it. In this respect, the low-pressure stage is especially suitable in respect to pressure and therefore especially suitable in respect to energy for feeding back the steam which is discharged from the overpressure vessel.

It therefore proves to be advantageous that the thermal energy which is present in the fed-back steam can be made available again in the water-steam cycle of the power plant for power generation. Furthermore, this steam which is fed back to the water-steam cycle saves using additional make-up water which in its turn would need to be treated again before it could be fed to the water-steam cycle.

It also proves to be advantageous that the accumulation of drainage waters and also steam, which would have to be fed to the environment, can be drastically reduced with regard to quantity. As a result, the sometimes relatively strict regulatory conditions and also environmental regulations can be more easily observed.

Also, as already indicated, the addition of make-up water (deionized water) for replacing the discharged drainage waters is significantly reduced, as a result of which the necessary demineralization for the deionized water can also be advantageously reduced in respect to cost and energy.

In comparison to the normal operation known from the prior art, a power plant can be operated with embodiments of the present invention therefore both more economically and more environmentally friendly and therefore with higher efficiency.

At this point, reference is to be made once more to the fact that the term steam is to be understood in the sense of water in vaporous form, as happens for example in the water-steam cycle. The quality of the water, for example on account of a changing content of different impurities, has no influence with regard to the meaning of the term. Equally, the term water is also to include waste water as well as useful water remaining in the water-steam cycle or condensation water. The same also applies to the steam which is discharged from the water-steam cycle as well as to the useful steam remaining in the water-steam cycle. In this respect, the term water or steam can also be equated to the term drainage waters according to case.

According to the embodiment, it is also possible that the number of first drainage lines is "one", i.e. according to embodiments of the invention the power plant comprises only one drainage line.

According to the embodiment, the overpressure vessel is designed as an expansion pressure tank on account of its pressure level in comparison to the pressure level of the water-steam cycle and in comparison to the pressure level of the environment.

According to a first preferred embodiment of the power plant, it is provided that the number of first drainage lines are connected on the upstream side to the water-steam cycle in the region of a high-pressure stage and/or intermediate pressure stage, especially in the region of a steam drum of the high-pressure stage and/or of a steam drum of the intermediate pressure stage. A fluidic connection "in the region" means in the local proximity, wherein a fluidic interaction is brought about. According to the embodiment, the connecting is especially carried out to the high-pressure stage and/or to the intermediate pressure stage, or to the steam drum of the high-pressure stage and/or to the steam drum of the intermediate pressure stage. The connecting can also be carried to a forced circulation steam generator of the high-pressure stage and/or to a forced circulation steam generator of the intermediate pressure stage.

Alternatively or even additionally, the number of first drainage lines can also be connected on the upstream side to the water-steam cycle in the region of the low-pressure stage, especially in the region of the steam drum of the low-pressure stage. The connecting can also be carried out to a forced circulation steam generator of the low-pressure stage.

On account of the pressure level which prevails in the high-pressure stage and/or intermediate pressure stage, an advantageous introduction, especially an energetically advantageous introduction, of the water or steam extracted from the water-steam cycle into the overpressure vessel is carried out. According to the embodiment, a change of the pressure level occurs there, especially an expansion of the steam, wherein the drainage waters, existing in the vaporous phase, which are discharged into the overpressure vessel can be advantageously fed back into the water-steam cycle again. On account of the relatively higher pressure level of the steam which is discharged from the high-pressure stage and/or intermediate pressure stage, a comparatively higher pressure level also especially exists in the overpressure level, which energetically benefits the feedback into the water-steam cycle.

According a further advantageous embodiment of the invention, it is provided that the power plant also has an atmospheric pressure vessel which enables a steam expansion to essentially atmospheric pressure, and which is connected in respect to piping to the overpressure vessel so that steam can be directed from the overpressure vessel into the atmospheric pressure vessel. The atmospheric pressure vessel and the overpressure vessel are therefore available for collecting drainage waters. The drainage waters are directed in vaporous phase from the overpressure vessel into the atmospheric pressure vessel, wherein the overpressure vessel can be changed over to a correspondingly lower pressure level. In this way, the atmospheric pressure vessel serves on the one hand for collecting drainage waters and at the same time also for pressure regulation of the pressure level in the overpressure vessel. Furthermore, the atmospheric pressure vessel enables a suitable discharging of the drainage waters without the overpressure vessel, for example during operation, having to be subjected to changes in respect pressure. Therefore, it is possible for example to discharge condensed drainage waters from the atmospheric pressure vessel into the environment, wherein this happens at a point in time at which the atmospheric pressure vessel and the overpressure vessel are not interconnected in a fluidically communicating manner. According to the embodiment, an expansion to essentially atmospheric pressure level should include a pressure level which corresponds to the atmospheric pressure level with a pressure tolerance of up to 20%.

Furthermore, it is also possible that a control means is included in the power plant which are designed for adjusting the quantity of steam which can be directed from the overpressure vessel into the atmospheric pressure vessel. The control means is especially connected in respect to piping between the overpressure vessel and the atmospheric pressure vessel. Accordingly, the control means can break the fluid connection between overpressure vessel and drainage water tank during draining of the condensed drainage waters which are present in the atmospheric pressure vessel so that a discharge from the atmospheric pressure vessel, which has no further influence with regard to the change of pressure level in the overpressure vessel, can be undertaken.

According to a further advantageous embodiment of the invention, it is provided that a number of second drainage lines are included and are connected on the upstream side to the water-steam cycle, and which are connected on the downstream side to the atmospheric pressure vessel, and via which water and steam can be fed from the water-steam cycle to the atmospheric pressure vessel. According to the embodiment, water and steam, which especially lies at a comparatively low pressure, can be transferred from the water-steam cycle into the atmospheric pressure vessel. It can also prove to be advantageous, according to the embodiment, to transfer drainage waters from the water-steam cycle into the atmospheric pressure vessel if the drainage waters collected therein are to be subjected to a form of treatment which differs from the drainage waters which are collected in the overpressure vessel.

According to the embodiment, it is furthermore possible that the number of second drainage lines is "one", i.e. according to embodiments of the invention the power plant comprises only one second drainage line.

According to an especially advantageous embodiment, it is provided that the number of second drainage lines are connected on the upstream side to the water-steam cycle in the region of the low-pressure stage. As already explained above, the terminology "in the region" means in a local region. According to the embodiment, the connecting is especially carried out to the low-pressure stage. The pressure level in the low-pressure stage is sometimes low enough in order to transfer steam into the atmospheric pressure vessel, which steam can be utilized without further energetic advantage for feeding back into the water-steam cycle. In this respect, it appears to be advantageous to feed the drainage waters which are discharged from the high-pressure stage and/or intermediate pressure stage to the overpressure vessel, whereas the liquid drainage waters which are discharged from the low-pressure stage are preferably intended for ejection into the environment. Drainage waters in vaporous form which are discharged from the low-pressure stage can preferably also be fed to the overpressure vessel, as already explained further above.

According to a further advantageous embodiment, it is provided that the atmospheric pressure vessel is connected to a recirculation line which enables water to be fed from the atmospheric pressure vessel to a first refrigeration source, and the thereby thermally treated water to be fed back into the atmospheric pressure vessel again. The recirculation of water from the atmospheric pressure vessel allows the avoidance of vapor formation in said atmospheric pressure vessel.

According to a further embodiment of the power plant, the overpressure vessel and/or the atmospheric pressure vessel are, or is, connected in respect to piping to a second refrigeration source which enables water which is discharged from the overpressure vessel and/or from the atmospheric pressure vessel to be thermally treated. In this respect, for example the drainage waters which are discharged from the overpressure vessel or from the atmospheric pressure vessel can be cooled before the further treatment or separation and purification. This cooling is necessary for the purification processes or treatment processes which for the most part are known from the prior art. This cooling can in turn be carried out by means of water from the main condenser of the power plant or water from an intercooler for provision of the second refrigeration source. The thereby treated water can in turn, according to the embodiment, be provided for feeding back into the water-steam cycle as deionized water.

According to a further embodiment of the invention, it is provided that the overpressure vessel and/or the atmospheric pressure vessel is connected in respect to piping to a collecting vessel into which water which is correspondingly present in the overpressure vessel and/or in the atmospheric pressure vessel can be transferred for storage. The collecting vessel especially enables the collection of condensed drainage waters and allows the merging of these before further purification and treatment of these drainage waters can be carried out, for example. The merging proves to be particularly practical and advantageous in respect to process and also for energy reasons.

According to a further development according to the embodiment, it is provided that the collecting vessel is connected in respect to piping to a treatment unit, wherein the treatment unit can clear the water at least partially of impurities. After purification of the water, existing as drainage waters, by means of the treatment unit, the re-treated water can be fed again to the water-steam cycle as make-up water (deionized water).

According to a continuation of this embodiment, it is also possible that the collecting vessel and/or the treatment unit are, or is, connected in respect to piping to the main condenser of the power plant in such a way that water from this can be fed to said main condenser. The main condenser in this case, as well as in the overall application, corresponds to the condenser in which is condensed the steam which is fed to the steam turbine(s) for power generation.

Embodiments of the invention are to be explained in more detail below with reference to individual figures. In this case, the features with the same technical effect preferably have the same designations.

Reference is furthermore to be made to the fact that the figures are only a schematic representation of embodiments of the invention idea, which does not constitute any limitation with regard to the practicability of embodiments of the invention.

Furthermore, the individual features which are represented in the following figures are claimed in isolation as well as in any combination with other features providing these come within the present inventive idea.

BRIEF DESCRIPTION

Figure 2:
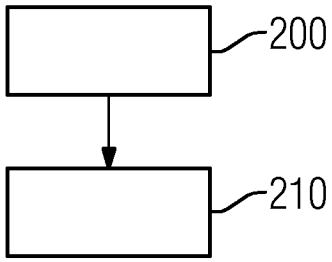

Some of the embodiments will be described in detail, with reference to the following figures, wherein like designations denote like members, wherein:

FIG. 1 shows a schematic representation of an embodiment of the power plant; and FIG. 2 shows a flow-diagrammatic representation of an embodiment of the method for operating a power plant.

DETAILED DESCRIPTION

FIG. 1 shows a possible embodiment of the present power plant 1 according to embodiments of the invention which has a water-steam cycle 2. According to the embodiment, the water-steam cycle 2 is included in the steam section of a gas and steam power plant 1. In this case, the water-steam cycle 2 has in all three different pressure stages 3, 5, 7 which serve for steam preparation. The steam which is prepared in these pressure stages 3, 5, 7 is fed, for power generation, to a steam turbine 90 (or to a plurality of steam turbines 90) which is, or are, fluidically connected to a main condenser 100 as a refrigerating source. It is also possible to conduct the steam which is prepared in the pressure stages 3, 5, 7, via bypass stations which are not additionally provided with designations, to the main condenser 100 for condensing.

In order to feed the drainage waters in the respective pressure stages 3, 5, 7—which accumulate during a start-up or shutdown operation or during normal operation or in the stationary mode of the power plant 1—to a purification plant or to a feedback line according to embodiments of the invention into the water-steam cycle 2, the power plant 1 provides a number of first drainage lines 11 which allow the drainage waters which are extracted from the pressure stages 3, 5, 7 to be fed to an overpressure vessel 20. In this case, the first drainage lines 11 are fluidically connected on the upstream side to corresponding line sections of the respective pressure stages 3, 5, 7. The first drainage lines 11 are especially fluidically connected on the upstream side to the steam drum 4 of the high-pressure stage 3 or to the steam drum 6 of the intermediate pressure stage 5. To this end, the first drainage lines 11 could alternatively be fluidically connected on the upstream side to a flange—not additionally shown—of a forced circulation steam generator of the high-pressure stage 3 or connected to a flange—not additionally shown—of a forced circulation steam generator of the intermediate pressure stage 5. A possible connection to the steam drum 8 of the low-pressure stage 7 also exists but which can also be dispensed with according to the embodiment. According to another advantageous embodiment, this last-named first drainage line 11 is not provided for discharging drainage waters from the low-pressure stage 7 into the overpressure vessel 20.

After introduction of the drainage waters into the overpressure vessel 20, a separation into vaporous and liquid proportions of the drainage waters is carried out, wherein the vaporous proportions can advantageously be fed back into the water-steam cycle 2 again. Since the steam does not exist in impure form, treated water/steam can therefore easily be made available to the water-steam cycle without further purification. To this end, a feed line 12 is fluidically connected to the overpressure vessel 20 and on the downstream side is connected to the steam drum 8 of the low-pressure stage 7. Therefore, it is possible to feed the steam which is present in the overpressure vessel 20 to the low-pressure stage 7 which is operated at a lower pressure level in comparison to the high-pressure stage 3 or the intermediate pressure stage 5, wherein the thereby fed back steam can be made available again for electric power generation by means of the turbine 90 (steam turbine). The turbine 90 can in this case also be designed as a number of individual turbines which are suitably connected to the respective pressure stages 3, 5, 7.

The power plant 1 furthermore comprises an atmospheric pressure vessel 30 which is also fluidically connected to the overpressure vessel 20. In the line which is provided for connecting purposes between the overpressure vessel 20 and the atmospheric pressure vessel 30 provision is also made for a control means 25 which allows the fluid connection to be interrupted or the fluid flow to be suitably adjusted. Therefore it is possible to transfer the steam which is present in the overpressure vessel 20 during operation to the atmospheric pressure vessel 30. As a result, on the one hand the pressure level in the overpressure vessel 20 can be suitably adjusted, and on the other hand the drainage waters which accumulate in the atmospheric pressure vessel 30 can be suitably discharged without the pressure level in the overpressure vessel 20 having to be altered at the same time. Therefore, according to the embodiment provision is made for a discharge line 35 via which especially water in vaporous form can be fed from the atmospheric pressure vessel 30 to the surroundings/environment U.

For draining the low-pressure stage 7, which operates at a comparatively lower pressure level, provision is made, moreover, for second drainage lines 13 which enable a transfer of the drainage waters which accumulate in the low-pressure stage 7 into the atmospheric pressure vessel 30.

In order to treat the drainage waters, especially in liquid form, which have accumulated in the overpressure vessel 20 as well as in the atmospheric pressure vessel 30, for further use in the water-steam cycle 2, they can be drained into a collecting vessel 70. For thermal conditioning, especially for cooling these drainage waters before introduction into the collecting vessel 70, provision is made according to embodiments of the invention for a first refrigeration source 50 as well for a second refrigeration source 60.

In addition, the power plant 1 provides a recirculation line 40 which allows drainage waters to be extracted from the atmospheric pressure vessel 30 in order to feed it to the first refrigeration source 50. After this, the thereby thermally conditioned drainage waters are completely or partially fed again to the atmospheric pressure vessel 30, but at a lower temperature level. This temperature treatment allows the reduction of an undesirable vapor formation in the atmospheric pressure vessel 30 since the steam is condensed.

FIG. 2 shows a flow-diagrammatic representation of an embodiment of the method according to embodiments of the invention for operating a power plant. In this case, the following steps are included:

draining water and/or steam from a water-steam cycle 2 by feeding to an overpressure vessel 20 (first method step 200);

feeding back steam from the overpressure vessel 20 to the water-steam cycle 2 in the region of a low-pressure stage 7, especially in the region of a steam drum 8 of the low-pressure stage 7 (second method step 210).

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. A coupled gas and steam power plant, comprising:

a plurality of first drainage lines that are fluidically connected on an upstream side to a water-steam cycle that has a plurality of pressure stages, and which are fluidically connected on a downstream side to an overpressure vessel, wherein at least one steam-conducting line is also fluidically connected to the overpressure vessel via which steam is fed again into the water-steam cycle;

wherein the at least one steam-conducting feed line feeds steam to the water-steam cycle in a region of a steam drum of a low-pressure stage.

2. The coupled gas and steam power plant as claimed in claim 1, wherein the plurality of first drainage lines are connected on the upstream side to the water-steam cycle in a region of a high-pressure stage and/or an intermediate pressure stage.

3. The coupled gas and steam power plant as claimed in claim 1, wherein the plurality of first drainage lines are connected on the upstream side to the water-steam cycle in a region of the low-pressure stage.

4. The coupled gas and steam power plant as claimed in claim 1, further comprising an atmospheric pressure vessel that enables a steam expansion to essentially atmospheric pressure, and which is connected in respect to piping to the overpressure vessel so that steam is directed from the overpressure vessel into the atmospheric pressure vessel.

5. The coupled gas and steam power plant as claimed in claim 4, wherein a control means is also included in the coupled gas and steam power plant and is designed for adjusting a quantity of steam which is directed from the overpressure vessel into the atmospheric pressure vessel.

6. The coupled gas and steam power plant as claimed in claim 4, wherein inclusion is made for a plurality of second drainage lines which are connected on the upstream side to the water-steam cycle, and which are connected on the downstream side to the atmospheric pressure vessel, and via which water and/or steam is fed from the water-steam cycle to the atmospheric pressure vessel.

7. The coupled gas and steam power plant as claimed in claim 6, wherein the plurality of second drainage lines are connected on the upstream side to the water-steam cycle in the region of the low-pressure stage.

8. The coupled gas and steam power plant as claimed in claim 1, wherein the atmospheric pressure vessel is connected to a recirculation line that enables water to be fed from the atmospheric pressure vessel to a first refrigeration source, and the thereby thermally treated water to be fed back into the atmospheric pressure vessel again.

9. The coupled gas and steam power plant as claimed in claim 4, wherein the overpressure vessel and/or the atmospheric pressure vessel are, or is, connected in respect to piping to a second refrigeration source that enables water which is discharged from the overpressure vessel and/or from the atmospheric pressure vessel to be thermally treated.

10. The coupled gas and steam power plant as claimed in claim 1, wherein the overpressure vessel and/or the atmospheric pressure vessel are, or is, connected in respect to piping to a collecting vessel into which water which is correspondingly present in the overpressure vessel and/or in the atmospheric pressure vessel is transferred for storage.

11. The coupled gas and steam power plant as claimed in claim 10, wherein the collecting vessel is connected in respect to piping to a treatment unit, wherein the treatment unit at least partially clears the water of impurities.

12. The coupled gas and steam power plant as claimed in claim 10, wherein the collecting vessel and/or the treatment unit are, or is, connected in respect to piping to a main condenser of the coupled gas and steam power plant in such a way that water is fed from this to the main condenser.

13. A method for operating a power plant as claimed in claim 1, comprising the following steps:

draining water and/or steam from the water-steam cycle by feeding to the overpressure vessel; and feeding back steam from the overpressure vessel to the water-steam cycle in the region of the steam drum of the low-pressure stage.

* * * * *